US005690387A

United States Patent [19]

Sarti

[11] Patent Number: 5,690,387

[45] Date of Patent: Nov. 25, 1997

[54] REMOVABLE HEADREST FOR CHAIRS

[76] Inventor: Ronnie A. Sarti, 1023 Bennett Ave., Glenwood Springs, Colo. 81602

[21] Appl. No.: 738,906

[22] Filed: Oct. 28, 1996

[51] Int. Cl.[6] ..... A47C 1/10

[52] U.S. Cl. ..... 297/397; 297/410

[58] Field of Search ..... 297/410, 391, 297/394, 397, 398, 402

[56] References Cited

U.S. PATENT DOCUMENTS

| | | | |
|---|---|---|---|
| 162,784 | 5/1875 | White . | |
| 280,078 | 6/1883 | Popplewell . | |
| D. 361,683 | 8/1995 | Juhl . | |
| 856,025 | 6/1907 | Brown | 297/410 X |
| 2,081,333 | 5/1937 | Hoover . | |
| 2,613,726 | 10/1952 | Paatero | 297/410 X |
| 2,949,152 | 8/1960 | Hipps et al. | 297/410 |
| 3,512,605 | 5/1970 | McCorkle | 297/397 X |
| 3,596,655 | 8/1971 | Corcoran | 297/391 X |
| 4,030,781 | 6/1977 | Howard | 297/397 |
| 4,440,443 | 4/1984 | Nordskog | 297/397 |
| 4,498,704 | 2/1985 | Hildreth . | |
| 4,989,836 | 2/1991 | Hudson, III et al. . | |
| 5,154,477 | 10/1992 | Lacy | 297/397 |
| 5,356,201 | 10/1994 | Olson . | |
| 5,475,882 | 12/1995 | Sereboff . | |
| 5,505,523 | 4/1996 | Wang | 297/397 X |
| 5,538,323 | 7/1996 | Henkel | 297/397 |

FOREIGN PATENT DOCUMENTS

| | | |
|---|---|---|
| 669879 | 1/1939 | Germany . |
| 2419483 | 11/1975 | Germany . |
| 1378430 | 12/1974 | United Kingdom . |

*Primary Examiner*—Milton Nelson, Jr.
*Attorney, Agent, or Firm*—Richard C. Litman

[57] ABSTRACT

A removable headrest for chairs includes a pocket which is formed to fit over the upper portion of the back of a chair, such as a folding lawn chair or the like. The headrest may be adapted to other types of chairs as well. The pocket portion is preferably formed of a resilient plastic material and includes a relatively thick back panel for structural strength, and a relatively thin front panel in order to conform comfortably to the upper back of a person seated in the chair. The pocket portion may have a single headrest support arm channel formed in the central back portion, or may alternatively include opposite support arm channels formed along each edge of the pocket. Greater versatility may be provided by including a central channel and both side channels in the same seat back pocket portion. The channels may be continuous or may be formed in several segments. The channels provide for the adjustable insertion of either a single central headrest support arm therein, or a pair of opposite support arms, according to the configuration of the pocket portion which fits over the back of the chair. A threaded bolt type support arm lock, or an over center cam lock may be used to fix the position of the support arm(s) as desired. A single headrest is affixed to the upper end of the single support arm, or alternatively a headrest band is extended between the two lateral support arms, according to the headrest configuration.

7 Claims, 7 Drawing Sheets

REMOVABLE HEADREST FOR CHAIRS

BACKGROUND OF THE INVENTION

1. Field of the Invention

The present invention relates generally to furnishings, seating, and accessories therefor, and more particularly to various embodiments of a removable, portable headrest which may be temporarily installed upon the back of a chair or the like for the support of a seated person's head. The device generally comprises a pocket which fits over the upper portion of the back of the chair, with a vertically adjustable headrest secured thereto. The device may be placed upon the back of a chair as desired, with the headrest being adjusted for optimum comfort. The device may be removed for storage or placement on another chair, as desired. The present removable headrest is particularly well suited for use with lawn chairs, deck chairs, and the like, but may be adapted for use with other types of chairs as well.

2. Description of the Prior Art

Lightweight, portable, and/or casual seating, such as folding lawn chairs, deck chairs, and the like, have been known for some time. One feature which is almost universal with such seating is the lack of any head support, due to this type of seating needing to be relatively simple, lightweight, and to fold to a compact size.

Accordingly, such seating generally provides only the bare minimum of comfort or convenience features, with no real attempt at padding or upholstery (other than perhaps some form of webbing), and often not even having arm rests, in the case of most folding metal chairs. While chaise lounges and the like may provide sufficient support for the head, such elongate recliners do not provide upright, chair-like seating. Other heavier upholstered chairs, as often found in the living areas of residences and the like, often have a seat back which is sufficiently high as to provide support for the head, but such seating is not particularly portable, nor is any headrest portion removable from such chairs.

Accordingly, a need will be seen for a removable, portable headrest for chairs such as lawn chairs, deck chairs, folding chairs, and other lightweight and portable seating. While the present headrest is adapted to be particularly suitable for such seating, it should be noted that it is also applicable to other types of seating as well. The device generally comprises a pocket which fits over the upper portion of the seat back, with a vertically adjustable headrest extending upwardly therefrom. The seat back pocket is preferably formed of plastic material, with the front portion thereof being relatively flexible compared to the opposite back portion, for comfort. The headrest may be supported by a single central arm, or two opposite lateral arms, as desired. A discussion of the prior art of which the present inventor is aware, and its distinctions from the present invention, is presented immediately below.

U.S. Pat. No. 162,784 issued on May 4, 1875 to Willard M. White describes a Head-Rest having a screw actuated clamp at the base thereof, for removable attachment to a chair or the like. The vertical adjustment for the headrest portion is limited, as the lower end of the arm holding the headrest fits into a pocket in the front portion of the removable base, rather than extending downwardly through the base. The present headrest support arm provides considerably more adjustment, as it passes completely through passages or channels in the back or sides of the pocket portion which fits over the back of the chair, and thus is not limited by a fitting residing on the front surface of the chair back, as in the case of the White device.

U.S. Pat. No. 280,078 issued on Jun. 26, 1883 to George Popplewell describes a Head Rest providing for removable attachment to the back of a railroad passenger car seat or the like. The device comprises a spaced apart pair of generally U-shaped members which grasp the upper edge of the seat back, with each having a threaded rod extending upwardly therefrom. An adjustable headrest is installed between the two threaded rods. At least one embodiment of the present invention may include a pair of spaced apart headrest supports with the headrest being installed therebetween, but Popplewell does not disclose any form of pocket which may be installed over the upper portion of the seat back, as provided by the present invention. The separate seat back grasping components would produce discomfort for the upper back of a seated person, unlike the smooth, continuous pocket of the present device.

U.S. Pat. No. 2,081,333 issued on May 25, 1937 to Myrl P. Hoover describes an Adjustable Chair having a high back with a vertically adjustable headrest movably secured thereto. The headrest slides upwardly and downwardly on a pair of spaced apart straps which are immovably affixed to the chair back, which principle of operation is opposite that of the present headrest which in each embodiment is at least vertically (or immovably) affixed to the support arm(s), with the arm(s) being adjustable relative to the seat back attachment pocket and thus to the chair itself. Moreover, the Hoover headrest may be adjustable, but it is not removable, as provided by the present headrest.

U.S. Pat. No. 4,498,704 issued on Feb. 12, 1985 to Joseph R. Hildreth describes a Headrest For Chair With Soft Backrest, comprising a pair of generally U-shaped flat members which are secured closely together to sandwich the flexible backrest member of a wheelchair or the like, therebetween. One of the U-shaped members is vertically adjustable relative to the other, to provide adjustment for a headrest affixed to the second U-shaped member. Again, the positioning of the two upwardly extending metal arms of the forwardly disposed U-shape member to reside against the back of the seated person, would create some discomfort even though the support members are relatively thin. The present invention provides an attachment member comprising a pocket which completely covers the upper portion of the chair back, thus providing a uniform surface for the back of a seated person to rest against.

U.S. Pat. No. 4,989,836 issued on Feb. 5, 1991 to E. W. Hudson III et al. describes a Detachable Wheelchair Headrest, comprising a pair of spaced apart generally vertical arms having a flexible headrest secured between the two arms. The two arms are clamped to the two tubular upright members of the seat back frame for the chair, rather than to a pocket which fits over the upper back of the chair, as in the present invention. (Such a pocket could not be used with a wheelchair, due to the rearwardly extending handgrips for the chair.) Hudson, III et al. describe the adjustment of the headrest band by turning one of the support members to wrap the band around the support, but this would result in an asymmetric configuration, unless sufficient slack existed to turn each member equally. This is critical in the Hudson, III et al. headrest, as they provide additional lateral head support means on the headrest band, which means must be symmetrically positioned. Moreover, the Hudson, III et al. headrest is not easily removable from its supports, while the present headrest is.

U.S. Pat. No. 5,356,201 issued on Oct. 18, 1994 to Jerome Olson describes a Canoe Backrest secured to a pair of vertically adjustable tubes, each of which extends upwardly from a mounting bracket. The brackets are bolted to the seat bottom, unlike the present pocket arrangement which slips over the seat back and is thus easily installable and removable without modification to the chair. The Olson backrest cannot be positioned sufficiently high to provide a headrest, as the length of the support arms would penetrate the bottom of the boat when retracted.

U.S. Pat. No. 5,475,882 issued on Dec. 19, 1995 to Joel L. Sereboff describes a Gel Filled Deformable Cushion And Composition Contained Therein. Sereboff does not disclose any means of mounting or attaching his cushion to another device, which feature is a critical part of a chair attachable headrest. The present removable headrest invention may make use of a gel filled cushion, but also provides for the attachment of such a cushion to a supporting structure which is in turn removably attachable to a chair or the like.

U.S. Pat. No. D-361,683 issued on Aug. 29, 1995 to Darrol L. Juhl illustrates a design for a Removable Lawn Chair Headrest. The design appears to disclose a pair of split cylindrical upright components which slip downwardly over each of the chair back uprights, and which have a headrest extending thereacross. A thicker component is secured behind the headrest by a pair of lateral rear straps extending between the two uprights. A crossmember is also provided between the uprights. No pocket is shown which may be removably secured over the upper portion of the seat back, as in the present invention, nor is any form of adjustment apparent for the headrest.

German Patent Publication No. 669,879 published on Jan. 6, 1939 illustrates a headrest which apparently secures to the back of a chair by means of a lateral strap therearound. Lateral retainers or clips secure to the upright members of the chair back. No pocket is disclosed which fits completely over the uppermost portion of the chair back, as provided by the present invention.

German Patent Publication No. 2,419,483 published on Nov. 13, 1975 illustrates a chair having an adjustable headrest affixed thereto. The headrest is supported by a pair of spaced apart support arms, and is vertically adjustable thereon. This is opposite the present configuration, wherein the headrest is affixed to the support arms and is not vertically adjustable relative to the arms, but rather the arms are vertically adjustable relative to the chair attachment pocket. The German '483 chair is specially constructed to accept the headrest portion, unlike the present invention comprising only a headrest assembly which is removably installable to any suitable unmodified chair. Thus, no removable pocket providing for the removable installation of the headrest to the upper portion of the chair back, is disclosed in the German '483 patent.

Finally, British Patent Publication No. 1,378,430 published on Dec. 27, 1974 describes Head Rests For Seats comprising a pair of spaced apart generally vertical headrest support members which are permanently and immovably secured to the back of the seat. The headrest is adjustably movable on the two support members, rather than being vertically affixed to the support members with the support members being adjustable relative to the seat back, as in the present invention. No removably installable pocket for the upper portion of the seat back is disclosed in the British patent, as provided by the present invention.

None of the above inventions and patents, taken singly or in combination, is seen to describe the instant invention as claimed.

SUMMARY OF THE INVENTION

Accordingly, it is a principal object of the invention to provide an improved removable headrest for chairs, comprising a pocket adapted to fit over the upper portion of the back of a chair with headrest support arm means adjustably installed therein, with the headrest support arm means including a headrest affixed to the upper end thereof.

It is another object of the invention to provide an improved removable headrest for chairs which headrest support arm means may comprise a single support arm adjustably lockable in position to the back of the pocket portion of the device, or which may alternatively comprise two support arms with each of the arms being adjustably lockable to one of the left and right edges of the pocket portion, or which may include support arm attachment means to the pocket portion, comprising three sets of attachment means disposed along the left edge, right edge, and rear center of the pocket portion of the device.

An additional object of the invention is to provide an improved removable headrest for chairs which support arm locking means may comprise a threaded bolt passing through the support arm, or which alternatively may be an over center cam locking device.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
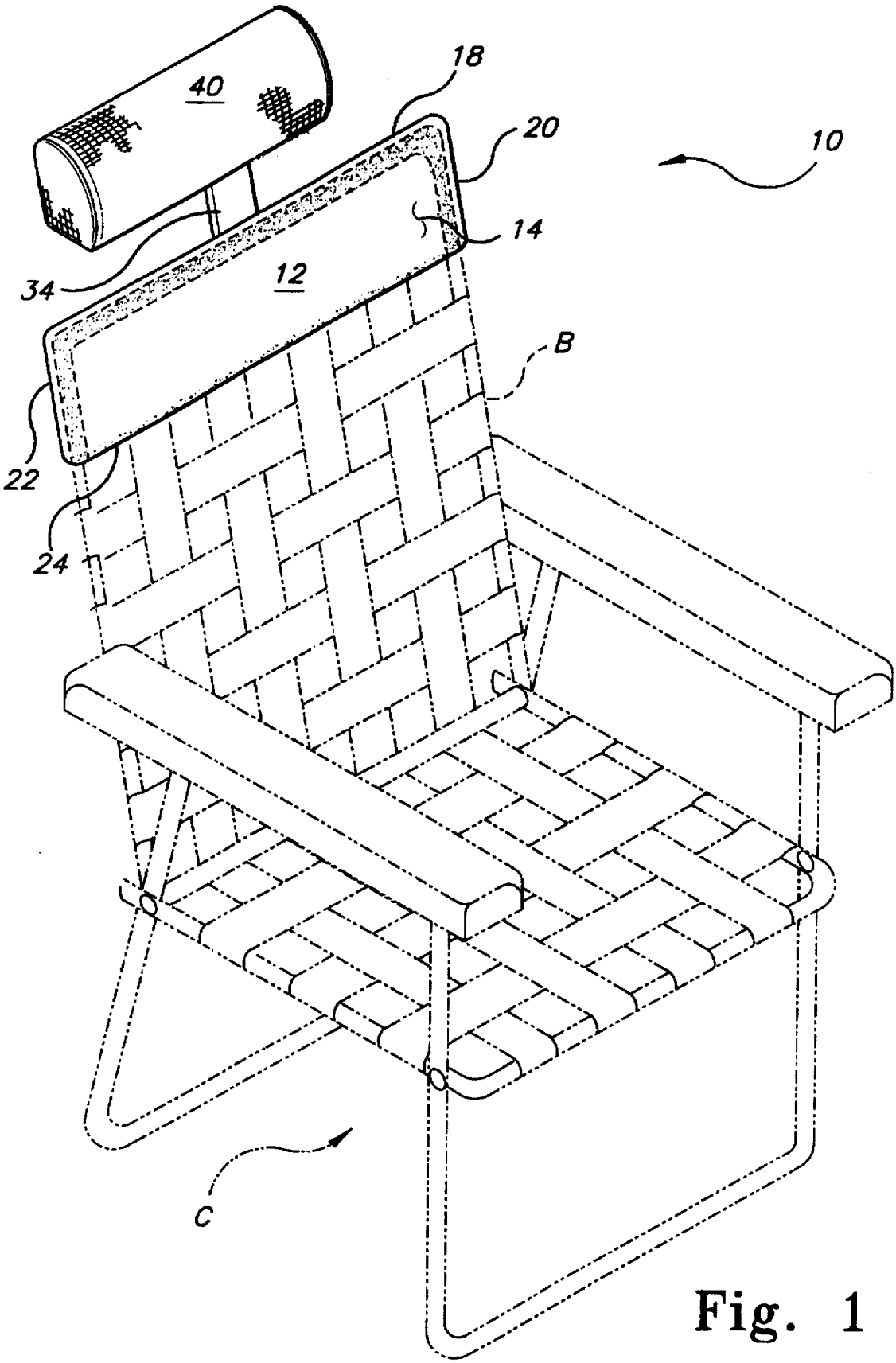
FIG. 1 is a perspective view of a first embodiment of the present removable headrest for chairs, showing the headrest removably installed on the upper back portion of a lawn chair.
Figure 2:
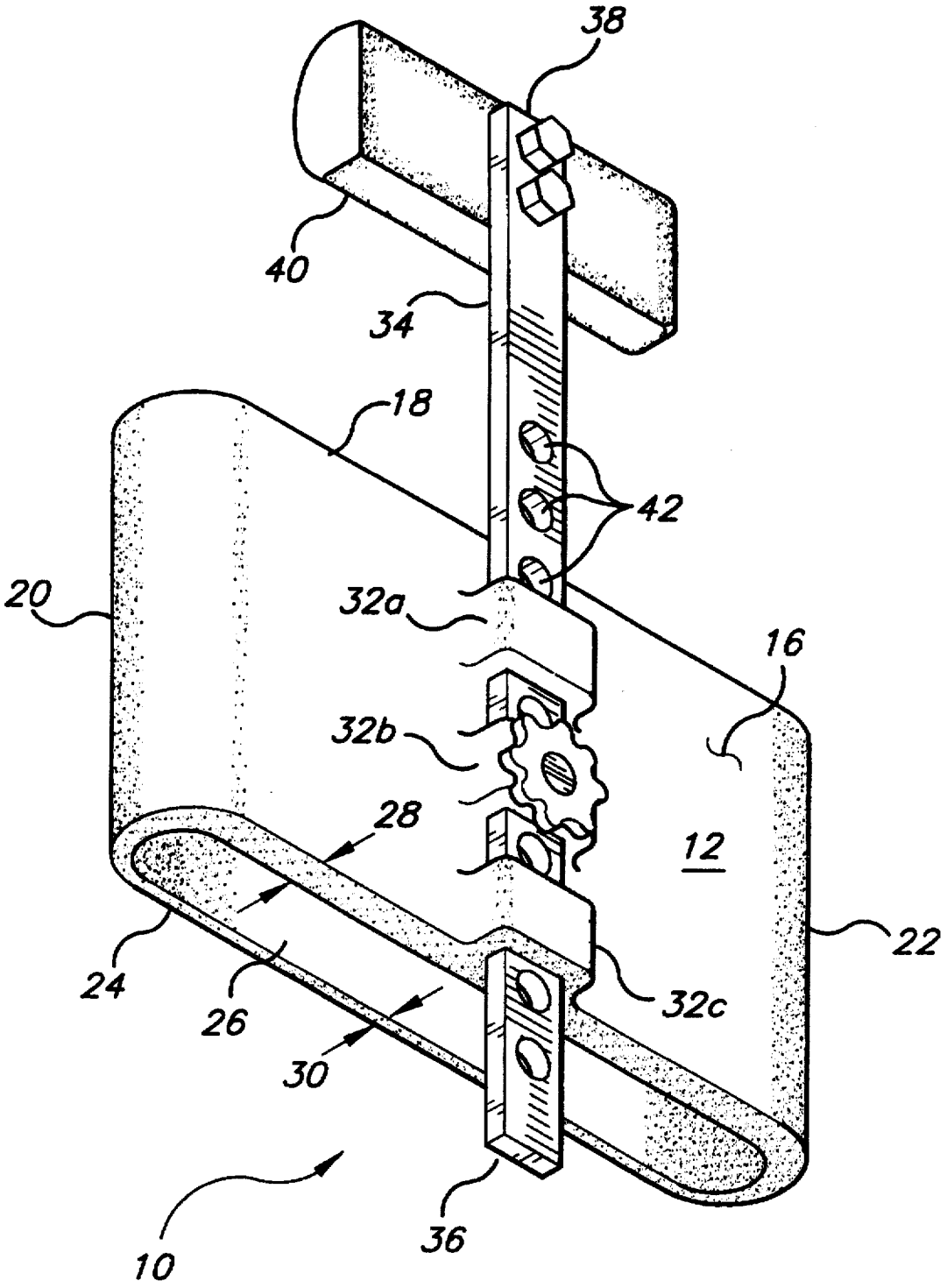
FIG. 2 is a rear perspective view of the removable headrest of FIG. 1, showing further details.

The present invention comprises various embodiments of a removable headrest for chairs, a first embodiment of which is shown in FIGS. 1 and 2, and designated with the reference numeral 10. The headrest 10 includes a pocket portion 12, which is adapted to fit closely over the upper portion of the back of a chair, such as the back B of the lawn chair C shown in FIG. 1. (It will be seen that the present headrest 10, and/or any of its embodiments, are also adaptable to other types of chairs having back portions, as well.) The pocket portion 12 has a front wall or surface 14, an opposite rear surface or wall 16, a closed upper edge 18, and opposite first and second lateral edges, respectively 20 and 22. The lower edge 24 is open, to provide access to the hollow interior 26.

The chair back pocket 12 may be formed using any of a number of materials and methods, but is preferably formed as a single, unitary component of semi-rigid plastic material. It will be noted that both good structural strength and compliance to the form of a person using the present headrest 10 may be achieved using such material. The rear wall 16 is formed to have a relatively greater thickness 28 than the relatively thin thickness 30 of the front wall 14, thus providing good structural strength in the rear wall 16 and also a flexible and compliant front wall 14, all in a single, unitary component.

The back 16 of the chair back pocket 12 includes a generally vertically oriented headrest support arm attachment channel formed thereon (preferably cast or molded integrally with the remainder of the pocket 12), as shown in FIG. 2. The channel may comprise a coaxial series of separate channel portions 32*a*, 32*b*, 32*c*, as shown in FIG. 2, or may alternatively comprise a single, continuous channel length, as shown in other embodiments. An elongate headrest support arm 34 is removably and adjustably installed within the channel 32*a/b/c*, with the support arm 34 having a lower end 36 and an opposite upper end 38. The upper end 38 of the headrest arm 34 includes some form of headrest means, e.g., the padded or upholstered resilient headrest pad 40 of FIGS. 1 and 2, which may be permanently or removably secured to the upper end 38 of the support arm 34.

It should be noted that the headrest pad 40 is not adjustably positioned relative to the headrest support arm 34 once it has been secured to the upper end 38 of the arm 34. Rather, all adjustment is provided by adjusting the position of the arm 34 within the channel 32*a/b/c*. In the embodiment of FIGS. 1 and 2, the headrest support arm 34 is provided with a plurality of adjustment locking holes or passages 42 therein, and the channel portion 32*b* includes a threaded passage or insert therethrough, similar to that shown in the continuous channel embodiment of FIG. 3. A cooperatingly threaded bolt having an adjustment knob thereon, is threaded through the passage and/or insert and a selected one of the locking passages 42, to secure the support arm 34 as desired.

Figure 3:
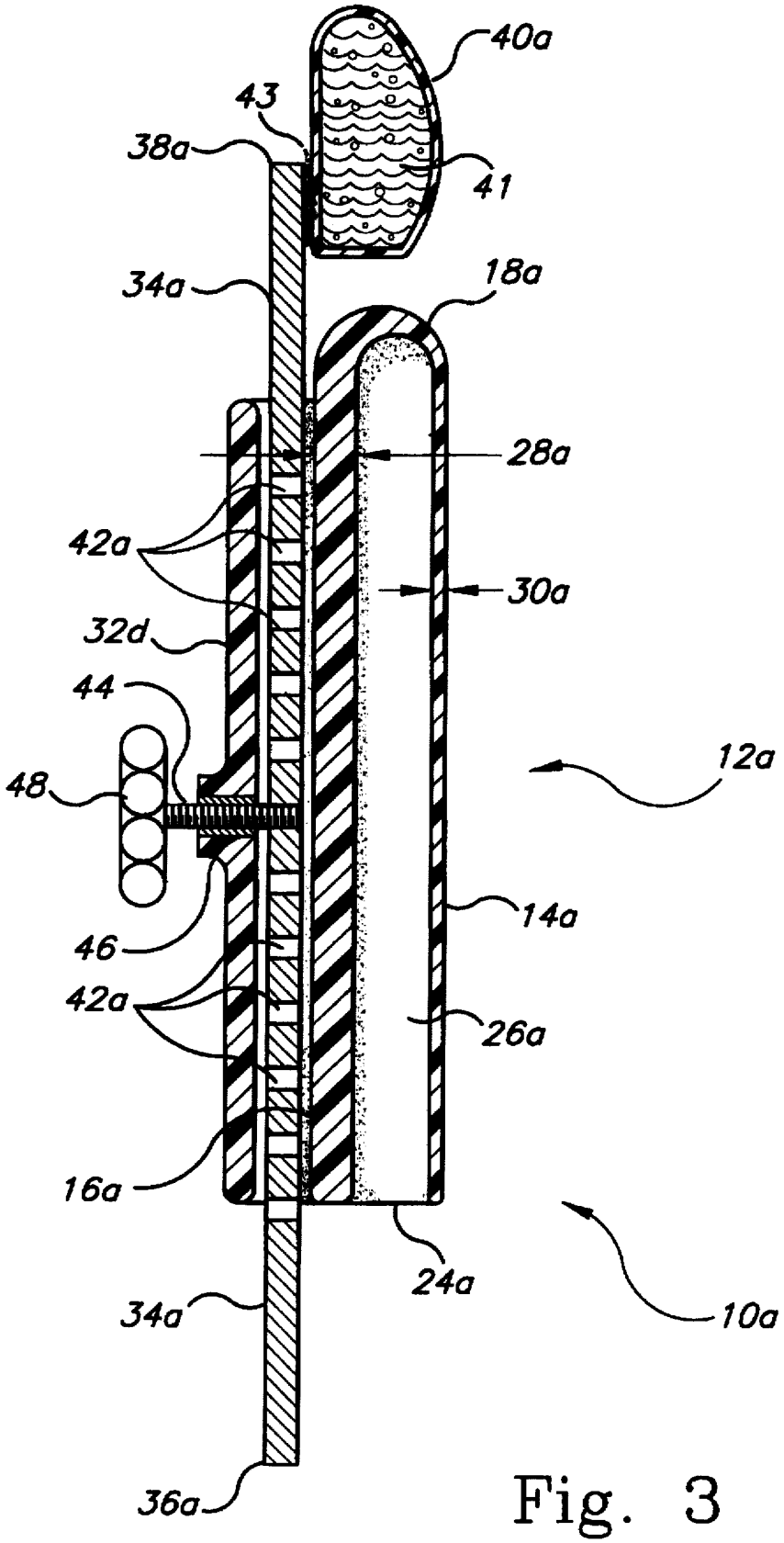
FIG. 3 is a side elevation view in section of an alternative embodiment of the present headrest, showing further details.

A modified version of the above described headrest is shown in FIG. 3 as headrest 10*a*and includes an adjustable headrest support arm 34*a* having a lower end 36*a* and an opposite upper end 38*a* similar to the headrests 10 of FIGS. 1 and 2. The primary distinction between the headrests 10 of FIGS. 1 and 2, and 10*a* of FIG. 3, is that the pocket 12*a* of FIG. 3 has a headrest support arm attachment channel 32*d* which is formed as a single, unbroken length extending substantially from the upper edge 18*a* to the lower edge 24*a* of the pocket portion 12*a*, rather than the plural channel segments 32*a/b/c* of the pocket 12 of FIGS. 1 and 2. Other components, such as the front wall 14*a* with its thin construction 30*a*, the thickness 28*a* of the rear wall 16*a*, and space 26*a* therebetween, are equivalent to similar features of the headrest 10 of FIGS. 1 and 2.

Also, the headrest pad 40*a* of FIG. 3 may include a gel filled interior portion 41, in lieu of dry foam or fiber cushion padding or fill. Such gels provide better conformity to the back of the head of a user of the present headrest 10*a*, and they may be chilled to provide benefits similar to an ice pack, if so desired. Accordingly, the gel filled headrest pad 40*a* is removable from the upper end 38*a* of the headrest support arm 34*a*, by means of cooperating hook and loop fastening material 43 or the like.

FIG. 3 also discloses the threaded bolt 44 and mating threaded insert 46 within the channel 32*d*, which arrangement may be incorporated into any of the embodiments of the present invention as desired, and as indicated in the exterior view of FIG. 2. The bolt 44 is operated by turning the knob 48 to remove the bolt 44 from one of the headrest adjustment arm passages 42*a*, or to tighten the bolt 44 to lock it into one of the passages 42*a*, as desired.

Figure 4:
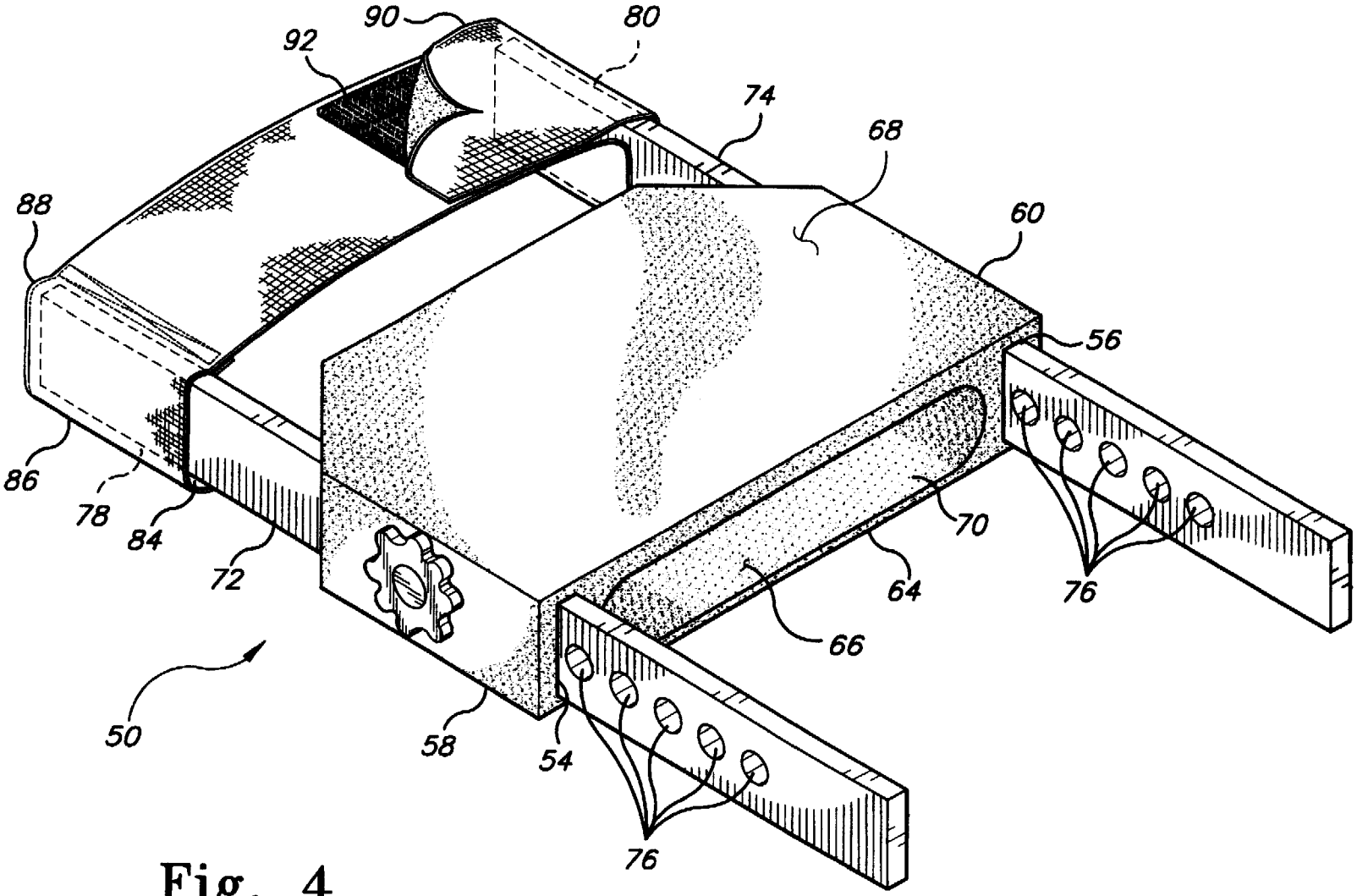
FIG. 4 is a rear perspective view of another alternative embodiment of the present headrest, showing details thereof.
Figure 6:
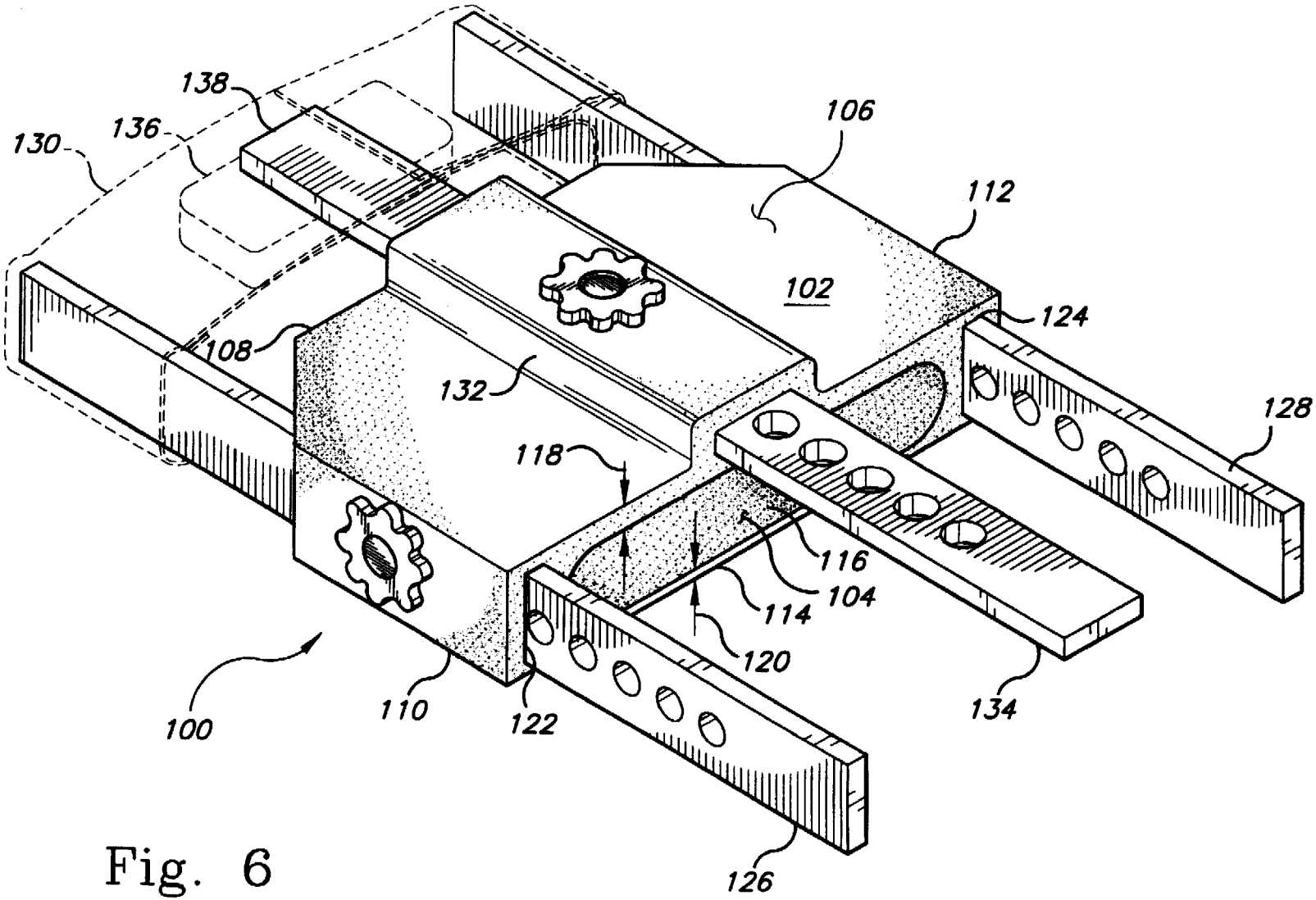
FIG. 6 is a rear perspective view showing another alternative embodiment, including both a single central support arm and two laterally disposed support arms in a single device.

FIG. 4 discloses an alternative embodiment, designated as headrest 50, in which the seat back pocket 52 includes opposite first and second lateral headrest support arm channels, respectively 54 and 56, which are formed integrally or otherwise affixed respectively to the first and second lateral edges 58 and 60 of the pocket 52. It will be seen that this configuration does not require a single, central headrest support arm channel (although one may be provided in addition to the two lateral channels, as shown in the embodiment of FIG. 6 discussed further below). Accordingly, while the seat back pocket portion 52 is otherwise similar to the pockets 10 and 10*a* discussed above, having an upper edge 62, an open lower edge 64, a thin front wall or panel 66, and a relatively thicker rear panel or wall 68 with a hollow interior 70 therebetween, the rear wall 68 is devoid of any headrest support arm attachment channel or means.

The first and second headrest support arm channels 54 and 56 each include a headrest support arm adjustably installed therein, respectively a first arm 72 and a second arm 74. Each of the arms 72/74 includes a plurality of locking holes or passages 76, with a locking bolt and insert mechanism, similar to that shown in FIG. 3 and discussed further above, being provided in each of the lateral channels 54 and 56. (It will be understood that while only a single locking knob is shown in FIG. 4, that the headrest assembly of FIG. 4 is substantially symmetrical and includes identical locking mechanisms on each side.)

The upper ends of the headrest support arms 72 and 74, respectively 78 and 80, provide for the removable and adjustable attachment of a headrest band 82 thereto. The headrest band 82 comprises an elongate sheet of flexible, pliable vinyl, fabric, or other suitable material, and includes a headrest support arm sleeve 84 sewn or otherwise formed at a first end 86 thereof. This sleeve 84 is closed (stitched, etc.) at the upper end 88 thereof, to preclude slippage of the first end 86 of the band 82 downwardly along the first headrest support arm 78. The opposite second end 90 of the headrest band 82 includes first and second portions 92 and 94 of mating hook and loop fastening material thereon, whereby the end 90 may be adjustably wrapped about the upper end 80 of the second headrest support arm 74 as desired, to provide the desired tension or slack in the headrest band 82.

Figure 5:
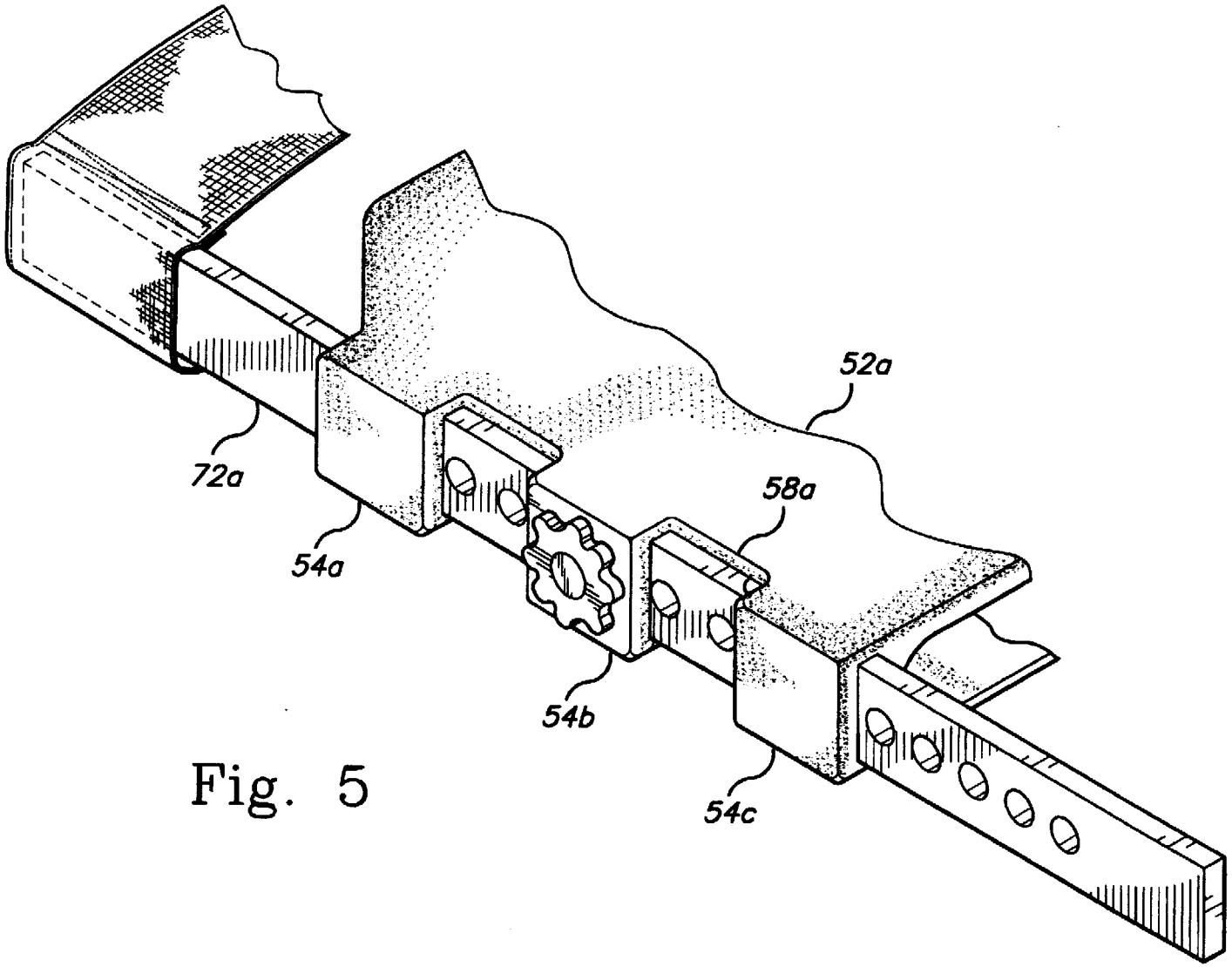
FIG. 5 is a fragmented perspective view showing details of an alternative support arm attachment means to the pocket portion.

In FIG. 4, the two lateral channels 54 and 56 are each shown as single, unbroken, elongate channels extending substantially from the upper end 62 to the lower end 64 of the seat back pocket portion 52. However, it will be seen that the alternative channel arrangement shown in FIG. 2, comprising a plurality of coaxial channel segments, may be used in the construction of plural channel headrest. Such a configuration is shown in FIG. 5 along the first edge 58*a* of a pocket 52*a*, having a plurality of channel segments 54*a*, 54*b*, and 54*c*. The locking means is disposed in the central channel segment 54*b*, to secure a first support arm 72*a* therein. Otherwise, the construction of the alternative headrest embodiment of FIG. 5 is identical to the embodiment of FIG. 4.

FIG. 6 discloses a further alternate embodiment, wherein a user of the device may select the specific type of headrest means (headrest pad or headrest band) used with the headrest pocket. In FIG. 6, a headrest 100 includes a seat back pocket 102 formed generally similarly to the pocket portion 52 of FIG. 4, having a front wall 104, an opposite rear wall 106, a closed upper edge 108, opposite closed first and second lateral edges 110 and 112, and an open lower edge 114 providing access to a hollow interior 116. As in the other embodiments discussed further above, the rear wall 106 may have a thickness 118 greater than the thickness 120 of the front wall, in order to provide good structural strength and still provide compliance with the back of a person using the headrest.

The seat back pocket 102 also includes opposite first and second lateral headrest support arm channels, respectively 122 and 124, along the respective first and second lateral edges 110 and 112. Each channel 122/124 has a headrest support arm, respectively 126 and 128, adjustably installed therein. These two arms 126/128 provide for the installation of a headrest band 130 thereon, similar to the configuration of the headrest 50 of FIG. 4. However, the rear wall 106 also includes a single central headrest support arm channel 132 thereon, with a single headrest support arm 134 adjustably installed therein having a single headrest pad 136 installed on its upper end 138. This embodiment allows a user of the headrest 100 to select whichever type of headrest he or she wishes to use. Other components (headrest arm locking means, etc.) are similar to those features of other embodiments discussed above.

Figure 7:
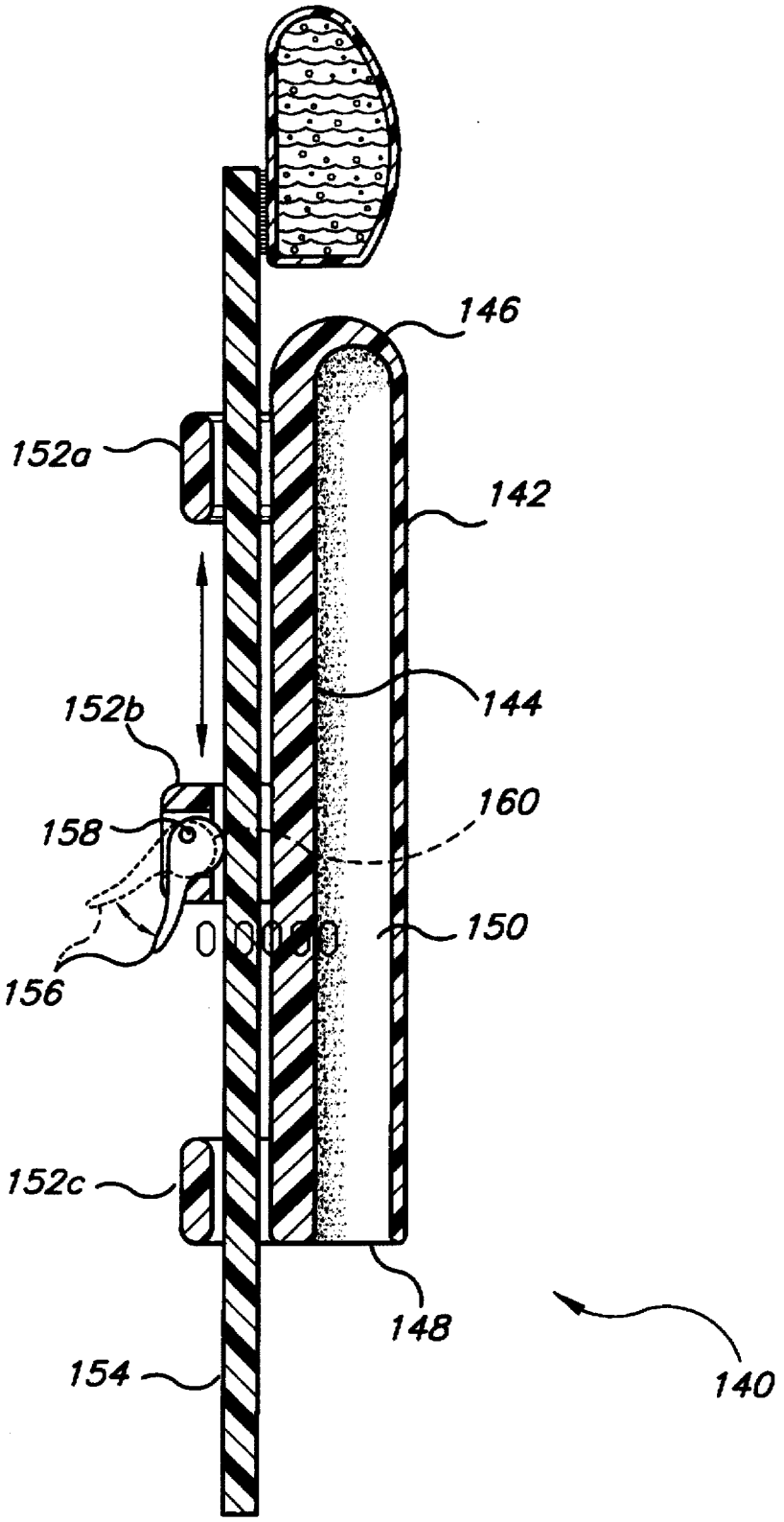
FIG. 7 is a side elevation view in section of an alternative locking means for the headrest support arm of the present invention.

To this point, only one specific type of headrest support arm locking means has been described, i.e., the threaded bolt and insert shown in detail in FIG. 3. However, other types of support arm locking means may be used, which are adaptable to any of the headrest embodiments described above. FIG. 7 discloses one such means, providing for the adjustable locking of a headrest support arm to the back of a chair back pocket 140. The pocket 140 includes a front wall 142, opposite rear wall 144, closed upper edge 146, open lower edge 148, and a hollow interior 150, as in other chair back pocket embodiments discussed above. A headrest support arm channel, comprising channel segments **152*a*, 152*b*, and 152*c*, holds a headrest support arm 154 adjustably therein. The support arm 154 may be formed of metal (e.g., stainless steel), or may alternatively be formed of plastic or other suitable material, as indicated by the cross sectional marking of FIG. 7, and it will be seen that the channel segments 152*a/b/c*** may alternatively comprise a single channel, as shown in the embodiment of FIG. 3.

The locking means disposed in the central channel segment **152*b* comprises an over center cam lever 156, which rotates about a pivot pin 158 which is installed laterally through the channel member 152*b*. The lever 156 includes a cam lobe 160 thereon, which passes over center (i.e., slightly beyond a point directly below the pivot pin 158) when the lever 156 is locked downwardly against the channel 152*b*. The lobe 160 also bears tightly against the headrest support arm 154 in this locked position, precluding movement of the arm relative to the headrest pocket 140**. (Clearances are exaggerated.)

To adjust the support arm 154 within the channel **152*a/b/c*, the lever 156 is lifted to draw the cam lobe 160 back from its bearing position against the surface of the support arm 154, as shown in broken lines in FIG. 7. Thus, the headrest support arm 154** may be adjusted to any of a practically infinite number of positions as desired, and locked into position to fix the position of the headrest relative to the chair back pocket as desired.

In summary, the above described removable headrest for chairs, in any of its embodiments, will be seen to provide a most useful and desirable accessory for lawn and garden furniture, as well as for virtually any other type of folding or non-folding chair which does not have a high back against which a seated person may rest their head. The semi-rigid plastic form of the chair back pocket provides the required structural strength, while still providing comfort to a user by means of the thin and flexible front wall or panel thereof. It will be seen that the chair back pocket may take on virtually any external appearance, as shown by the various smoothly rounded and squared, truncated shapes shown in the various drawing figures of the present disclosure; other shapes may be provided as desired. The chair back pocket may provide for only a single resilient headrest pad having a foam, fiber, or gel center, or may alternatively provide two supports for a headrest band spanning the two supports, or may even provide for either alternative, depending upon the configuration of the headrest support arm channels provided on the chair back pocket. The various headrest support arms described herein may be formed of a durable, corrosion resistant metal (i.e., stainless steel) for long life outdoors, or may alternatively be formed of virtually any suitable material (aluminum, plastic, etc.), depending upon the structural requirements and desired longevity as opposed to the economics of construction of the present device. Either finite or infinite adjustment may be provided, depending upon the locking means provided to secure the headrest support arm(s) in place relative to the chair back pocket. The above described accessory provides a most economical means to expand the comfort provided by an otherwise ordinary chair.

It is to be understood that the present invention is not limited to the sole embodiments described above, but encompasses any and all embodiments within the scope of the following claims.

I claim:

1. A removable headrest adapted to fit over the upper portion of a chair back, comprising:

a pocket portion having a front wall, a rear wall, a closed upper edge and opposite first and second lateral edges, and an open lower edge communicating with a hollow interior;

said pocket portion including at least one headrest support arm attachment channel disposed thereon, said at least one headrest support arm attachment channel having a threaded insert therein;

at least one elongate headrest support arm adjustably securable within said at least one headrest support arm attachment channel, with said at least one headrest support arm having a lower end and an opposite upper end, and a plurality of locking passages therethrough;

headrest means disposed upon said upper end of said at least one headrest support arm, and;

locking means disposed within said at least one headrest support arm attachment channel, said locking means providing for the selective locking of said headrest support arm within said at least one channel and comprising a threaded bolt secured through said threaded insert of said channel and one of said locking passages of said headrest support arm to affix said support arm selectively within said channel.

2. The removable headrest according to claim 1, wherein:

said pocket portion includes a single headrest support channel centrally affixed to said rear wall of said pocket portion, with said support channel including a single headrest support arm adjustably installed therein and said upper end of said headrest support arm including a single resilient headrest pad immovably affixed thereto.

3. The removable headrest according to claim 1, wherein:

said at least one headrest support arm attachment channel is selected from the group consisting of a single, unbroken length extending substantially from said upper edge to said lower edge of said pocket portion, and a plurality of coaxial channel segments extending substantially from said upper edge to said lower edge of said pocket portion.

4. The removable headrest according to claim 1, wherein:

said pocket portion is formed of plastic and includes a thick rear wall providing structural strength and a thin and resilient front wall conforming to the back of a user of said headrest and providing for the comfort of the user.

5. A removable headrest adapted to fit over the upper portion of a chair back, comprising:

a pocket portion having a front wall, a rear wall, a closed upper edge and opposite first and second lateral edges, and an open lower edge communicating with a hollow interior;

said pocket portion including a single headrest support arm attachment channel disposed centrally on said rear wall thereof, said headrest support arm attachment channel comprising a plurality of coaxial channel segments extending substantially from said upper edge to said lower edge of said pocket portion;

an elongate headrest support arm adjustably securable within said headrest support arm attachment channel, with said headrest support arm having a lower end and an opposite upper end;

a soft and resilient headrest pad disposed upon said upper end of said headrest support arm, and;

locking means disposed within said headrest support arm attachment channel, said locking means providing for the selective locking of said headrest support arm within said channel[, whereby;

said pocket portion of said removable headrest is removably installed over the upper portion of the chair back and said headrest support arm is adjustably secured within said headrest support arm channel by said locking means to position said headrest pad as desired for a user of the chair].

6. The removable headrest according to claim 5, wherein:

said headrest support arm includes a plurality of locking passages therethrough, said headrest support arm attachment channel includes a threaded insert therein, and said locking means comprises a threaded bolt adapted to secure through said threaded insert of said channel and one of said locking passages of said headrest support arm to affix said support arm selectively within said channel as desired.

7. The removable headrest according to claim 5, wherein:

said pocket portion is formed of plastic and includes a thick rear wall providing structural strength and a thin and resilient front wall conforming to the back of a user of said headrest and providing for the comfort of the user.

* * * * *